US009822496B2

(12) United States Patent
Park

(10) Patent No.: US 9,822,496 B2
(45) Date of Patent: Nov. 21, 2017

(54) PREFABRICATED MOLD FOR CONSTRUCTING CURBS

(71) Applicant: Hae Young Park, Yeongju-si (KR)

(72) Inventor: Hae Young Park, Yeongju-si (KR)

( * ) Notice: Subject to any disclaimer, the term of this patent is extended or adjusted under 35 U.S.C. 154(b) by 0 days.

(21) Appl. No.: 15/109,043

(22) PCT Filed: Jul. 15, 2015

(86) PCT No.: PCT/KR2015/007369
§ 371 (c)(1),
(2) Date: Jun. 29, 2016

(87) PCT Pub. No.: WO2016/047908
PCT Pub. Date: Mar. 31, 2016

(65) Prior Publication Data

US 2016/0326704 A1 Nov. 10, 2016

(30) Foreign Application Priority Data

Sep. 23, 2014 (KR) ..... 10-2014-0126547

(51) Int. Cl.

| | |
|---|---|
| ***E01C 19/50*** | (2006.01) |
| ***B28B 1/14*** | (2006.01) |
| ***B28B 7/00*** | (2006.01) |
| ***B28B 11/24*** | (2006.01) |
| ***E01C 11/22*** | (2006.01) |

(52) U.S. Cl.
CPC ..... *E01C 19/506* (2013.01); *B28B 1/14* (2013.01); *B28B 7/0029* (2013.01); *B28B 11/245* (2013.01); *E01C 11/222* (2013.01); *E01C 11/223* (2013.01)

(58) Field of Classification Search
CPC ..... E01C 19/502; E01C 19/506; B28B 11/245
USPC ..... 249/2–7; 404/7
See application file for complete search history.

(56) References Cited

U.S. PATENT DOCUMENTS 1,644,586 A * 10/1927 Heltzel ..... E01C 19/506 249/155
3,395,884 A * 8/1968 Laukala ..... E01C 19/506 249/216

(Continued)

FOREIGN PATENT DOCUMENTS

KR 10-2011-0051567 A 5/2011
KR 10-1158445 B1 6/2012

(Continued)

*Primary Examiner* — Gary Hartmann
(74) *Attorney, Agent, or Firm* — Egbert Law Offices, PLLC

(57) ABSTRACT

A prefabricated form for use in constructing a casting cured concrete curb having a plurality of engaging pieces in which adjacent engaging pieces are abutted. Each of the engaging pieces has a fixing rod insertion hole formed therein. A plurality of spacer insertion holes are formed longitudinally and aligned respectively with the fixing rod insertion holes. The plurality of plate-shaped lower spacers are received respectively of the plurality of spacer insertion holes. Fixing rods are respectively inserted into the fixing rod insertion hole so as to engage the plate-shaped lower spacers. A plurality of upper spacers are engaged with the upper ends of the fixing rods so as to fix the engaging pieces in spaced relation to each other.

1 Claim, 3 Drawing Sheets

(56) References Cited

U.S. PATENT DOCUMENTS

| | | | | |
|---|---|---|---|---|
| 4,451,022 | A * | 5/1984 | Sauger | E04G 13/00 249/158 |
| 2006/0255234 | A1* | 11/2006 | Thigpen | E04G 17/12 249/5 |
| 2016/0199998 | A1* | 7/2016 | Daul | B28B 7/02 249/2 |

FOREIGN PATENT DOCUMENTS

| | | | |
|---|---|---|---|
| KR | 10-2013-0000494 | A | 1/2013 |
| KR | 10-2013-0047096 | A | 5/2013 |
| KR | 10-2014-0003924 | A | 1/2014 |

* cited by examiner

PREFABRICATED MOLD FOR CONSTRUCTING CURBS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a prefabricated form for a kerb construction and a construction method of a kerb using the same wherein when a kerb is constructed at a boundary between a road and a sidewalk, the kerb can be constructed using a prefabricated form, and the installation and disassembling of the kerb are easy, and the kerb can be reused, and in particular to a synthetic resin type prefabricated form wherein the upper and lower sides of each form are engaged butted, a fixing rod insertion hole is formed at an upper center and both sides of each form, and a joint filler is installed at an inner side, and a plurality of lower spacer insertion holes are formed in the forms of longitudinal holes at regular intervals at a lower end of a body. When it needs to install the thusly configured synthetic resin type prefabricated form at both sides of a road, a form support member equipped with a mounting groove is disposed supporting a lower end of the form at one side, and a fixing rod is installed at a lower end of the form installed at both ends in such a way to insert a lower spacer into the insertion hole, and a form for a kerb construction is installed by inserting the fixing rod, and an upper spacer at the top of the fixing rod, and subsequently, concrete is cast and cured, thus finishing the constructing of a kerb.

2. Description of Related Art Including Information Disclosed Under 37 CFR 1.97 and 37 CFR 1.98.

The kerb, in general, is a means for separating a road and a sidewalk. A prefabricated product manufactured in a stone or a concrete-molded structure with a predetermined height difference high enough to form a shoulder between the road and the sidewalk is transferred to a construction site and then is installed. Alternatively, the kerb can be installed using a separate form. The aforementioned kerb, in general, is installed via a process wherein a separate form is installed at both sides of a concrete road after the concrete road has been constructed.

More specifically, the construction method of a kerb is carried out in such a way to install a prefabricated product or a separate kerb form.

As conventional technologies, there are the Korean patent registration No. 10-1196603 (a kerb construction form and a kerb construction method using the same), and the Korean patent registration No. 10-1158445 (a form for a kerb installation and a kerb installation engineering method using the same). The former technology is directed to a kerb construction form structure which is formed of an elevation guide engaged to the outer sides of a road side form panel and a sidewalk side form panel and equipped with a guide hole corresponding to an elevation guide hole of each of the road side form panel and the sidewalk side form panel, an elevation piece engaged to both ends of an elevation towing bar and engaged upwardly and downwardly elevatable to the elevation guide, and an elevation height adjusting unit engaged to the upper end surface of each of the road side form panel and the sidewalk side form panel and equipped with a height adjusting screw configured to elevate upwardly and downwardly the elevating piece with respect to the elevating guide when its lower end is engaged to the elevating piece and rotates.

The latter technology is directed to an engineering method for installing a kerb which is formed of a step for installing a batter board, a step for arranging kerb rests, a step for mounting the kerb on the rest, a step for installing in a row a casting board, a step for installing a horizontal connection part, a step for installing a guide part, a step for engaging a cover, a step for casting and curing concrete, and a step for removing the forms of the casting board and the cover.

The former technology is directed to an elevation height adjusting unit which is able to adjust a setting height when installing a prefabricated kerb, wherein the height of the prefabricated kerb can be easily adjusted. In the structure of the aforementioned form, the height of the form can be adjusted in such a way that the forms are connected using a connection pin like in the conventional form, and a kerb support member is engaged using bolts, and the elevation height adjusting unit is operated. In this case, as problems, installation and disassembling procedures may become complicated, and work time may extend, and a prefabricated kerb is employed.

The latter technology is directed to an engineering method which also uses a prefabricated kerb, wherein a bolting work should be carried out so as to connect casting boards of both sides using a horizontal connection member, and concrete should be cast and cured by installing a support member to support a kerb. In this case, work time may extend, and multiple workers and a lot of time are necessary when separating a casting board after the concrete has cured.

BRIEF SUMMARY OF THE INVENTION

The present invention has been made in an effort to solve the above-described problems associated with prior art.

It is an object of the present invention to provide a prefabricated form for a kerb construction, and a construction method of a kerb using the same, wherein upper and lower ends of both sides are engaged butted, so engaging and separations can be carried easily, and the inside of the kerb is made hollow, thus minimizing weight. A joint filler is installed at an inner side, which makes it possible to easily adjust the height of a concrete casting, and longitudinal holes are formed at regular intervals at a lower end of the body, and a lower spacer is inserted into a spacer insertion hole, thus installing a fixing rod, and an upper spacer is fixedly inserted into the fixed rod and the top of the fixed rod, and it is fixed at a lower end of the form of the road side in such a way to use a form support member, by means of which the construction of a kerb can be easily carried out. Since a prefabricated form which is injection-molded using a synthetic resin, can be used, manufacturing is easy, and strength is high, and weight can be minimized, which may result in the semi-permanent use. Installation, disassembling and transfer are easy. Since the forms can be prefabricated, a minimum number of workers is necessary when installing and disassembling the forms, thus reducing work time. The manufacturing cost and maintenance cost can be minimized. Since the prefabricated forms can be used when constructing a kerb, work convenience can be enhanced, and construction period can be reduced.

To achieve the above objects, there is provided a prefabricated form for a kerb construction wherein concrete is cast and cured, thus building a kerb, which may include, but is not limited to, engaging pieces which are engaged abutted at the upper and lower ends of both sides thereof in tapered shapes, wherein fixing rod insertion holes are formed at the upper center and the engaging pieces of both sides, and a form is injected and molded using a synthetic resin in such a way that a hollow space is formed inside thereof, and a joint filter is installed at an inner upper portion of the form, and space insertion holes are formed longitudinal at the lines of the fixing rod insertion holes at a lower end of the body of the form, and plate-shaped lower spacers at both sides of which the fixing rod insertion parts are formed, are inserted therein, and when each fixing rod is inserted into the fixing rod insertion holes, the fixing rod can be fixed via the fixing rod insertion parts, and upper spacers wherein the fixing rod insertion parts are formed, are inserted at the tops of the fixing rods of both sides, whereby the forms of both sides are fixed, and a lower end of the form of one side among the forms of both sides is inserted in the form support member wherein the form mounting grooves are formed and is fixed using a concrete nail.

To achieve the above objects, there is provided a construction method of a kerb using a prefabricated form for a kerb construction, which may include, but is not limited to, a process wherein a form is installed at a road side and a sidewalk side, respectively, which are spaced-apart at the interval of a kerb so as to install the form, and form support members are fixed using concrete nails at regular intervals at the lines where the road side forms are installed, and a lower end of the road side form is mounted in a mounting groove, and the form is installed on the ground at the sidewalk side, and lower spacers are inserted from the road side to the sidewalk side in the spacer insertion holes formed at the lower ends of the form of both sides, and the fixing rods are inserted in the fixing rod insertion holes formed at the tops of the forms of both sides, and the fixing rods are inserted and fixed through the fixing rod insertion parts of the lower spacers, and the fixing rod insertion parts of the upper spacers are inserted into the tops of the fixing rods of both sides, thus fixing the tops of the forms of both sides, and subsequently concrete is cast and cured, whereby a kerb is constructed, and the forms can be disassembled in the sequence of the upper spacers, the fixing rods, the forms of both sides, and the form support members, and both sides of each of the plate-shaped lower spacers which have been bent upward, are cut off when disassembling the forms.

Advantageous Effects

In the present invention, a form can be manufactured by injection-molding a synthetic resin, and a kerb construction can be carried out using the thusly manufactured forms, by means of which manufacturing is easy, and strength is high, and a finished product is light, and a semi-permanent use is available. Installation, disassembling and transfer are easy when constructing the kerbs. Since the forms are prefabricated, a minimum number of works is necessary, and work time can be reduced, and a manufacturing cost and maintenance cost can be minimized. Since the forms used to construct kerbs can be fixed and installed in a prefabricated way, work convenience can be enhanced, and construction period can be reduced.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DETAILED DESCRIPTION OF THE INVENTION

The configuration and operation of the present invention will be described with reference to the accompanying drawings.

Figure 1:
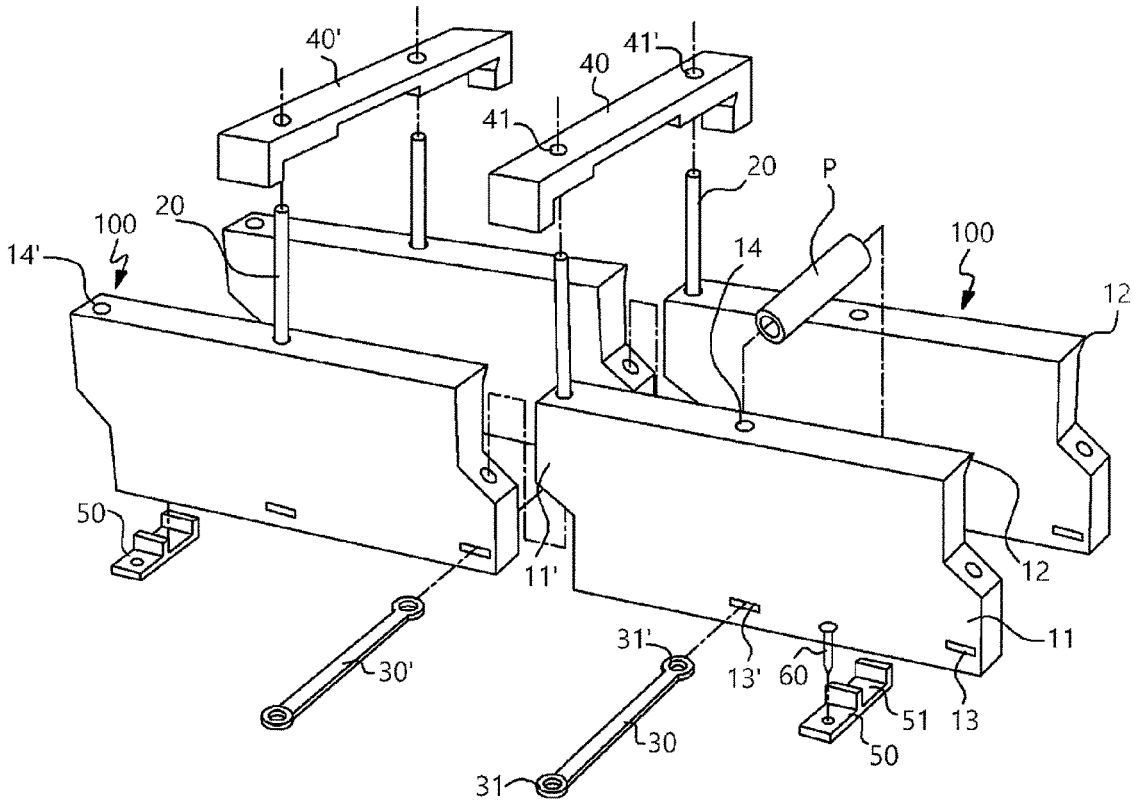
FIG. 1 is a separated perspective view illustrating the configuration of a prefabricated form according to the present invention.
Figure 2:
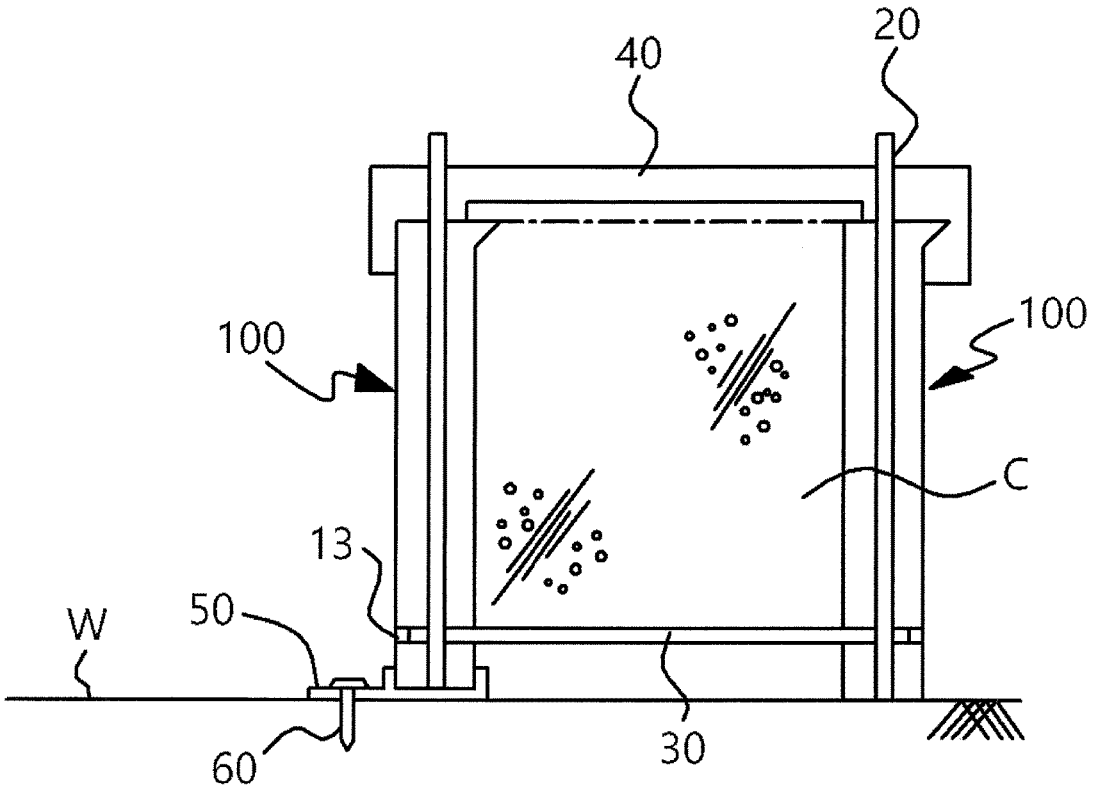
FIG. 2 is a cross sectional view illustrating a prefabricated form according to the present invention.
Figure 3:
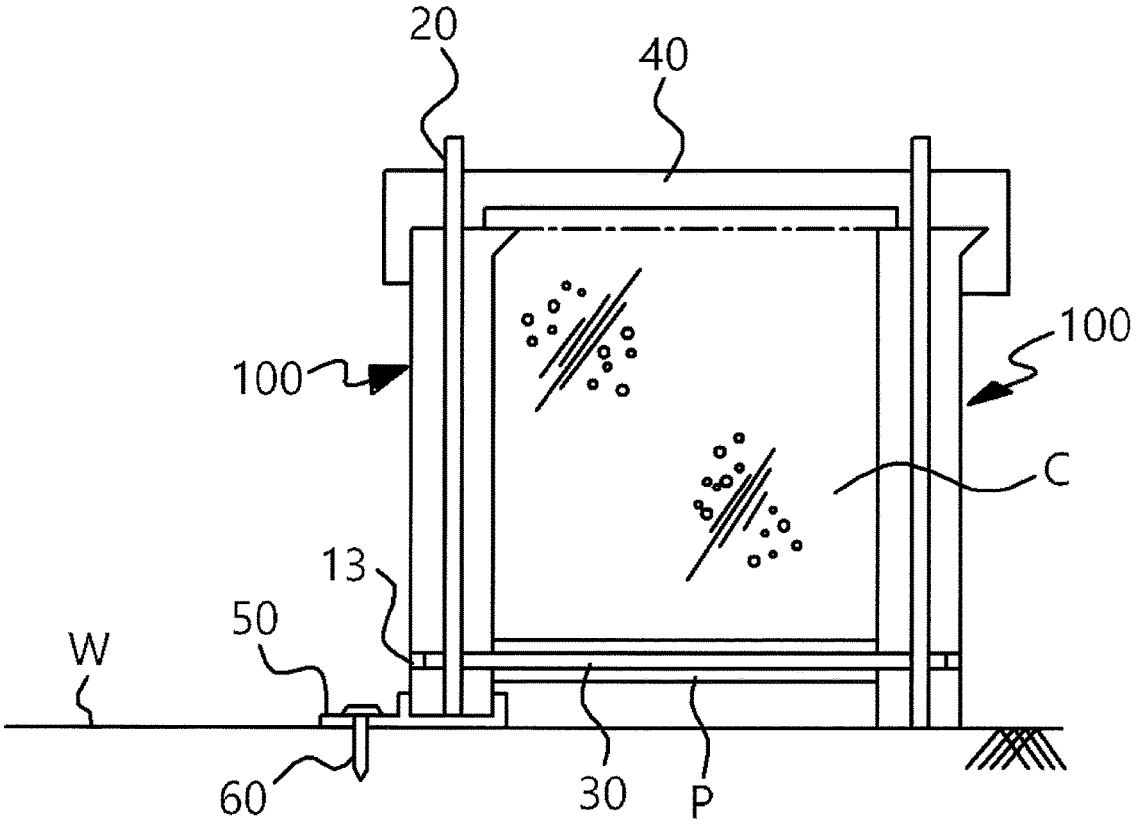
FIG. 3 is a cross sectional view illustrating a prefabricated form according to another embodiment of the present invention.

FIG. 1 is a separated perspective view illustrating the configuration of a prefabricated form according to the present invention, wherein a road side form is installed at the form support member, and a separate form is installed at the sidewalk side, and a lower spacer is inserted into the forms of both sides and is fixed using a fixing rod, and the upper portions of the form are fixed using the upper spacer, and then concrete is cast and cured, thus building a road kerb, and FIG. 2 is a cross sectional view illustrating a prefabricated form according to the present invention, wherein a prefabricated form formed of a form support member, the forms of both sides, a lower spacer, a fixing rod and an upper spacer is assembled, thus building a kerb, and FIG. 3 is a cross sectional view illustrating a prefabricated form according to another embodiment of the present invention, wherein when a lower spacer is inserted into the forms of both sides, it is passed through the inside of a pipe, by which the lower spacer can be collected after the construction is finished.

In the form used for the kerb which is constructed in such a way that concrete is cast and cured, fixing rod insertion holes 14 and 14' are formed at the engaging pieces 11 and 11' and are tapered at upper and lower portions of both sides thereof, and the form 100 is injected and molded using a synthetic resin, with the inside thereof being hollow, and a joint filler 12 is installed at an inner upper portion of the form 100, and spacer insertion holes 13 and 13' are formed longitudinal at the lines of the fixing rod insertion holes 14 and 14' at the lower end of the body of the form 100, and plate-shaped lower spacers 30 and 30' wherein the fixing rod insertion parts 31 and 31 are formed, are inserted at both sides, and when each fixing rod 20 is inserted into the fixing rod insertion holes 14 and 14', the fixing rod 20 is inserted through the fixing rod insertion parts 31 and 31' and then is fixed, and upper spacers 40 and 40' wherein fixing rod insertion parts 41 and 41' are formed, are inserted into the tops of the fixing rods 20 of both sides, thus fixing the forms 100 of both sides, and the form support member 50 wherein a form mounting groove 51 is formed, is inserted at a lower end of the form 100 of one side between the forms 100 of both sides and is fixed using a concrete nail 60.

There is provided a construction method of a kerb using a prefabricated form for a kerb construction, which may include, but is not limited to, a process wherein a form 100 is installed at a road side and a sidewalk side, respectively, which are spaced-apart at the interval of a kerb so as to install the form 100, and form support members 50 are fixed using concrete nails 60 at regular intervals at the lines where the road side forms are installed, and a lower end of the road side form 100 is mounted in a mounting groove 51, and the form 100 is installed on the ground at the sidewalk side, and lower spacers 30 and 30' are inserted from the road side to the sidewalk side in the spacer insertion holes 13 and 13' formed at the lower ends of the form 100 of both sides, and the fixing rods 20 are inserted in the fixing rod insertion holes 14 and 14' formed at the tops of the forms 100 of both sides, and the fixing rods 20 are inserted and fixed through the fixing rod insertion parts 31 and 31' of the lower spacers, and the fixing rod insertion parts 41 and 41' of the upper spacers 40 and 40' are inserted into the tops of the fixing rods 20 of both sides, thus fixing the tops of the forms 100 of both sides, and subsequently concrete is cast and cured, whereby a kerb is constructed, and the forms can be disassembled in the sequence of the upper spacers 40 and 40', the fixing rods 20, the forms 100 of both sides, and the form support members 50, and both sides of each of the plate-shaped lower spacers 50 which have been bent upward, are cut off when disassembling the forms 100.

When the prefabricated form is disassembled after the kerb has been built, it can be carried out in a state where both sides of the plate-shaped lower spacers 50 and 50' are bent upwardly. In this state, the construction can be finished as it is after a plastering work. During the procedure wherein the plate-shaped lower spacers 50 and 50' are installed, the pipes (P) may be installed at the road side and sidewalk side forms 100, and the lower spacers 50 and 50' are passed through the insides thereof and are installed, and the lower spacers 50 and 50' are collected after the construction is finished, and the pipes (P) will remain embedded at the kerb.

Reference character (C) in the drawings represents concrete, and (W) represents a concrete road.

The present invention provides a prefabricated form for a kerb construction and a construction method of a kerb using the same, wherein a kerb is constructed in such a way to cast and cure concrete, since a form made by an injection and molding method using a synthetic resin material, manufacturing is easy, and a firmness and stability are good, and a lightness and semi-permanent use are available, and an installation, a disassembling and transportation are easy, and the form can be manufactured in a prefabricated type, so a minimum number of workers is required when installing and disassembling the forms, by which work time can be reduced, and a manufacturing cost and a maintenance cost can be saved. Since the construction of a kerb can carried out using the aforementioned prefabricated form, a work convenience can be enhanced, and construction period can be reduced.

As illustrated in FIG. 1, in the configuration of the prefabricated form 100, the engaging pieces 11 and 11' are installed tapered at the upper and lower ends of both sides, wherein one side thereof is installed at the upper portion, and the other side thereof is installed at the lower portion, whereby a plurality of the forms 100 can be engaged butted when they are installed.

The form 100 is made of a synthetic resin and can be manufactured via an injection molding method or an extrusion molding method. A predetermined space is made inside of each form 100, which may reduce the whole weight thereof. The spacer insertion holes 13 and 13' may be formed longitudinal at the sides of the lines of the fixing rod insertion holes 14 and 14' at the lower end of the body, wherein the fixing rod 20 is inserted into the fixing rod insertion holes 14 and 14', respectively. The plate-shaped lower spacers 30 and 30' wherein the fixing rod insertion parts 31 and 31' are formed at both sides thereof, can be inserted into the spacer insertion holes 13 and 13'.

The engaging pieces 11 and 11' installed at both sides of the form 100 are engaged abutted and can be fixed via fixing rod insertion parts 31 and 31' formed at the upper center of the form 100 and at the engaging pieces 11 and 11' of both sides.

Since the engaging pieces 11 and 11' are engaged abutted at both sides of the form 100, and the fixing rod 20 is inserted into the fixing rod insertion holes 14 and 14' formed at the upper center of the form 100 and the engaging pieces 11 and 11' of both sides, it can be fixed via the fixing rod insertion parts 31 and 31' of the lower spacers 30 and 30'.

The form 100 may be installed upright at both sides of the road side and the sidewalk, and the form 100 at the road side can be installed in such a way that the joint filler 12 is disposed in the inward direction that concrete is cast, and when concrete is cast and cured, the form 100 installed at the road side can be inserted in the mounting groove 51 and can be supported in such a way that the form support member 50 is fixed at the concrete road (W) and the ground surface.

The forms 100 of both sides can be fixed in such a way that the lower end of the fixing rod 20 inserted in the fixing rod insertion holes 14 and 14' of the forms 100 of both sides is fixed by the lower spacers 30 and 30, and the upper end thereof is inserted in the fixing rod insertion parts 41 and 41' of the upper spacers 40 and 40'.

As illustrated in FIG. 2, when the prefabricated forms are installed and fixed, concrete (C) is casted from above and is cured, thus constructing a kerb.

After the kerb has been constructed, the disassembling of the prefabricated forms can be carried out in such a way that the upper spacers 40 and 40' are separated, and subsequently, the fixing rod 20 is separated.

Thereafter, the forms 100 of both sides are separated. The centers of the lower spacers 30 and 30' which are disposed supporting the lower side thereof are embedded in the concrete (C), and the fixing rod insertion parts 31 and 31' of both sides are disposed protruding outward of the concrete (C) and are bent upward by the force generating when the form 100 is separated.

The bent portions may be cut off or finished via a plastering work during the post process.

As illustrated in FIG. 3, when the plate-shaped lower spacers 50 and 50' are installed based on the construction method, the pipe (P) may be installed at the inner sides of the road side and sidewalk side forms 100, and the lower spacers 30 and 30' may be inserted into the road side spacer insertion holes 13 and 13' and may be passed through the inside of the pipe (P) and then are installed inserted in the sidewalk side spacer insertion holes 13 and 13', thus constructing a kerb. After the construction of the kerb has been finished, the lower spacers 50 and 50' are collected, and the pipe (P) may remain embedded at the kerb.

Alternatively, a nightglow reflection cap may be inserted in a hollow space formed due to the pipe (P) for the sake of easier recognition at night.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A prefabricated form for use in constructing a cast and cured concrete kerb, the prefabricated form comprising:

a plurality of engaging pieces in which adjacent engaging pieces are abutted at an upper end and a lower end thereof, said upper and lower ends having tapered shapes, each engaging piece of said plurality of engaging pieces having a fixing rod insertion hole formed at an upper center thereof, said plurality of engaging pieces defining the form in which the form has a hollow space therein, each of said plurality of engaging pieces being formed of an injection molded synthetic resin material, wherein a plurality of spacer insertion holes are formed longitudinally and aligned respectively with the fixing rod insertion holes, said plurality of spacer insertion holes located at a lower end of the plurality of engaging pieces;

a plurality of plate-shaped lower spacers being received respectively in said plurality of spacer insertion holes;

a plurality of fixing rods respectively inserted into a plurality of fixing rod insertion holes, said plurality of fixing rods engaging respectively said plurality of plate-shaped lower spacers;

a plurality of upper spacers engaged respectively with upper ends of said plurality of fixing rods, said plurality of upper spacers having ends that abut said plurality of engaging pieces so as to fix respective pairs of plurality of engaging pieces in spaced relation; and a plurality of form support members engaged respectively to a lower end of said plurality of engaging pieces, the form support member having a form mounting groove that receives the engaging piece, the form support member adapted to be fixed to an underlying surface by a concrete nail.

* * * * *